US006101082A

United States Patent [19]

Benkaroun et al.

[11] Patent Number: 6,101,082

[45] Date of Patent: Aug. 8, 2000

[54] CONTROL CIRCUIT FOR AN ELECTROMAGNET

[75] Inventors: Karim Benkaroun, Sartrouville; Yves Guermeur, Evreux; Daniel Riffaud, Paris, all of France

[73] Assignee: Schneider Electric SA, Boulogne Billancourt, France

[21] Appl. No.: 09/177,377

[22] Filed: Oct. 23, 1998

[30] Foreign Application Priority Data

Oct. 24, 1997 [FR] France ..... 97 13480

[51] Int. Cl.[7] ..... H01H 47/04

[52] U.S. Cl. ..... 361/191; 361/154; 361/210

[58] Field of Search ..... 361/152–156, 361/160, 191, 210

[56] References Cited

U.S. PATENT DOCUMENTS 3,689,808 9/1972 Stampfli .

5,510,951 4/1996 Briedis et al. ..... 361/154

5,592,356 1/1997 Ryl et al. ..... 361/154

5,717,562 2/1998 Antone et al. ..... 361/155

FOREIGN PATENT DOCUMENTS 0 196 960 10/1986 European Pat. Off. .

*Primary Examiner*—Fritz Fleming

*Attorney, Agent, or Firm*—Oblon, Spivak, McClelland, Maier & Neustadt, P.C.

[57] ABSTRACT

Control circuit for electromagnet with two coils used to determine a call phase and a hold phase, and powered from a DC power source. The energy source comprises a current generator and a capacitor powered by this current generator. A control device controls two switches, in which the first switch controls discharge of the capacitor in the first coil during the call phase, and the second switch sets up current passing through a second coil during the call phase and the hold phase. The required current output from the current generator is thus reduced.

6 Claims, 1 Drawing Sheet

CONTROL CIRCUIT FOR AN ELECTROMAGNET

CROSS REFERENCE TO RELATED APPLICATIONS

This application claims benefit of priority to French Patent Application No. 97 13480 filed Oct. 24, 1997, the entire disclosure of which is incorporated by reference herein.

BACKGROUND OF THE INVENTION

1. Field of the Invention

This invention relates to a control circuit for an electromagnet with two coils, namely the first coil energized on call and the second coil energized on hold, this circuit comprising a DC power source to power the coils and a first switch and a second switch associated with the call coil and the hold coil respectively to control passage of current.

2. Discussion of the Background

Patent DE-21 28 651 describes a control circuit for an electromagnet with two coils. In the call phase, which lasts for a duration determined by the charge in a capacitance at a level determined by a Zener diode, the two coils are powered to provide the energy necessary to close the electromagnet. Only one of the coils is powered continuously in the hold phase. But this control circuit has the disadvantage that it needs an energy source capable of supplying the call to both coils at the same time.

The purpose of this invention is to obtain a low level energy source, for example similar to call and hold, and to simplify the control circuit necessary for this purpose.

SUMMARY OF THE INVENTION

According to the invention:

- the energy source comprises a current generator and a capacitance powered by this current generator,
- a control device controls a first switch and a second switch, such that the first switch controls the capacitance discharging into the first coil during the call phase, and the second switch sets up current passing in the second coil during the call phase and during the hold phase, and interrupts the current when it is no longer required.

Thus the current generator may be designed to supply a constant and relatively low amount of power; the electromagnet call energy is derived from the permanent energy developed by the second coil using the current generator and the make-up energy developed by the first coil using the capacitance.

In a simple embodiment, the first switch is located between the current generator and the capacitance and is connected to the current generator through a non-return diode, whereas the second switch is placed in series with the parallel assembly of the two coils so that it is closed during the call phase and during the hold phase and is open at rest.

In some cases, the current generator can output an adjustable current amplitude, since the control device is connected to the current generator to send a higher current set value to it during the call phase than during the hold phase. The available energy at the time of the call can thus be increased while maintaining the advantage obtained according to the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The control circuit shown is associated with the electromagnet E in an electromechanical contactor, in which it is required to close and open the contacts in response to an On or Off order. The control circuit comprises terminals A1, A2 connected to a DC voltage source or a rectified AC voltage source V; application of this voltage is determined by a mechanical or electrical On-Off switch S. The positive terminal A1 and the negative terminal A2 of the circuit are connected through positive conductor 1 and negative conductor 2 respectively to a control device 10 and two coils L1, L2 that generate the required ampere-turns.

There is a current generator 11 at the input to the control circuit, capable of outputting a relatively low and preferably constant current, for example of the order of 100 mA.

The top terminal of coil L1 is connected to the positive conductor 1 through a non-return diode D1 and a switch T1, for example composed of a transistor. The upper terminal of the coil L2 is directly connected to the positive conductor 1. Coils L1 and L2 are laid out in parallel and their lower terminal is connected to the negative conductor 2 through a switch T2 for example consisting of a transistor. A Zener diode Z1 may optionally be provided to bypass switch T2. A capacitance C1 used to power coil L1 in the call phase is connected between the upper terminal of L1 and the negative conductor 2.

The control device 10 has inputs 10*a*, 10*b* connected to the circuit on the input side of the current generator 11, and to a point on the circuit close to the capacitance C1, to detect the voltage V and the capacitance voltage VC1 respectively; it has outputs 10*c*, 10*d* to control switches T1 and T2 respectively. The current generator 11 outputs a high current level 12*a* or a low current level 12*b* as a function of a switching signal or a switchable current set value output by control device 10.

Figure 1:
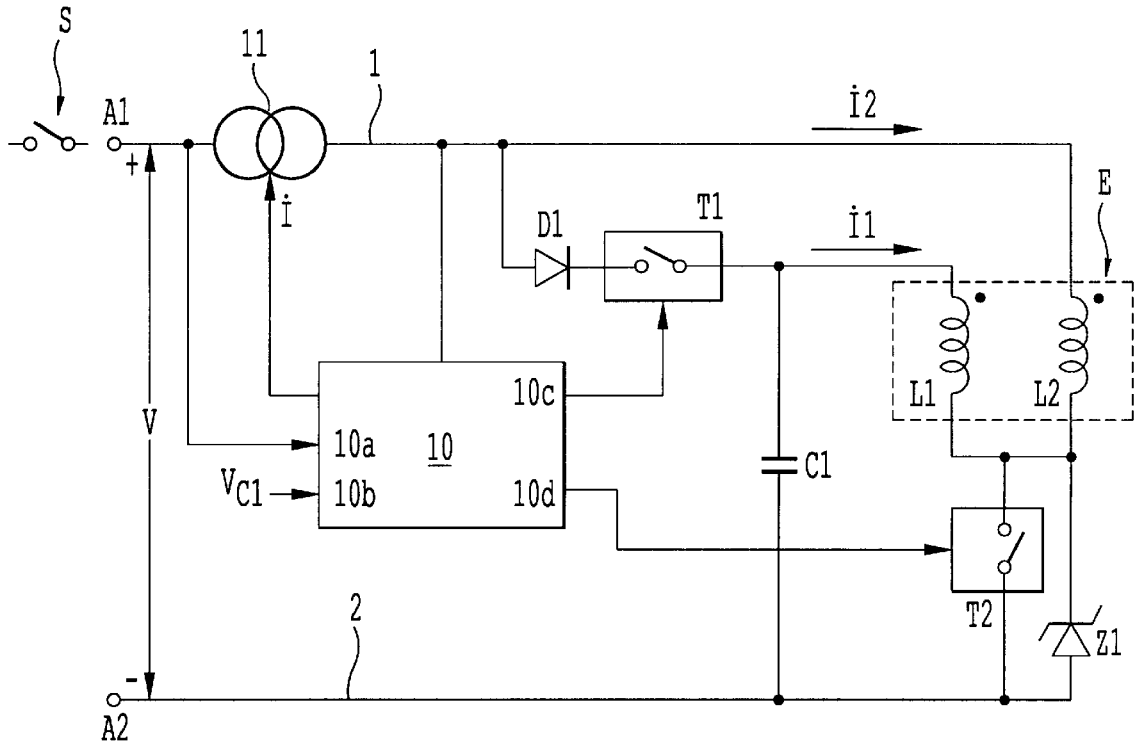
FIG. 1 shows the diagram of a control circuit according to the invention.
Figure 2:
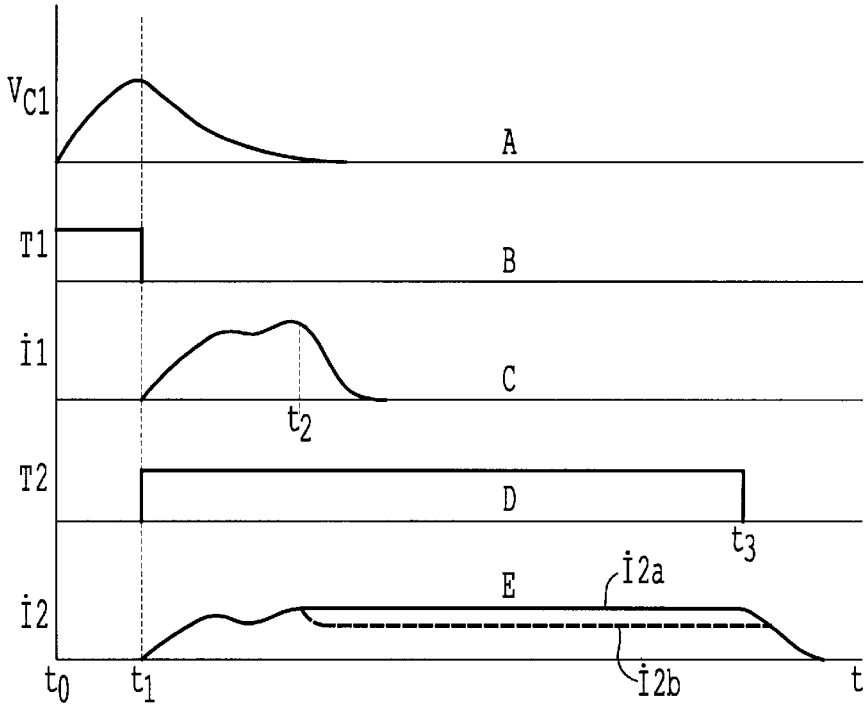
FIG. 2 contains a chart showing the variation of current in the coils during a control cycle.

We will now explain the operation of the control circuit with reference to FIG. 2.

Switch S is initially open, such that the electromagnet is deactivated and the contactor contacts are open; switch S is closed at time t0 to activate the electromagnet to close the contactor contacts.

As soon as the control device detects a sufficient voltage at terminals A1, A2 on its input 10*a*, it triggers the call phase by making T1 conducting while holding T2 blocked, such that the capacitance C1 charges (FIG. 2-A).

At time t1, the control device detects a sufficient charge voltage in capacitance C1 at its input 10*b*, and consequently it blocks T1 and makes T2 conducting (FIGS. 2-B and 2-D). The result is that the capacitance C1 discharges into coil L1 (FIG. 2-C), while coil L2 is powered directly by the current generator 11 (left part of FIG. 2-E). The energy then supplied by coils L1 and L2 together close the contacts of the contactor.

The end t2 of the call phase is determined by device 10 that leaves transistors T1, T2 in the previous state and transmits a change set value signal to the current generator 11, which for example changes from 100 mA to 50 mA to reduce the energy consumption in the control circuit during hold (see right part of the FIG. 2-E). The electromagnet is de-energized by cutting off the power supply to coil L2 at time t3 by opening switch S.

Obviously, numerous modifications and variations of the present invention are possible in light of the above teachings. It is therefore to be understood that within the scope of the appended claims, the invention may be practiced otherwise than as specifically described herein.

What is claimed is:

1. A control circuit comprising:

an electromagnet comprising a first coil and a second coil to determine a call phase and a hold phase;

a capacitor coupled to the first coil;

a current generator configured to power the coils and to charge the capacitor;

a first switch coupled to the first coil;

a second switch coupled to the first coil and the second coil, wherein the current generator powers the second coil via the second switch during the call phase and the hold phase; and a control device configured to control the first switch and the second switch, wherein the second switch controls discharge of the capacitor into the first coil during the call phase.

2. The control circuit according to claim 1, further comprising:

a non-return diode coupled to the current generator and the first switch, the first switch being coupled to the capacitor.

3. The control circuit according to claim 1, wherein the first coil and the second coil are in parallel, the second switch being in series with the coils.

4. The control circuit according to claim 1, wherein the current generator outputs an adjustable current amplitude signal, the control device being coupled to the current generator to send a current set value signal to the current generator during the call phase and the hold phase.

5. A method for controlling an electromagnet having a first coil and a second coil to determine a call phase and a hold phase, the method comprising:

powering the coils by a current generator;

charging a capacitor by the current generator; and switchably controlling discharge of the capacitor into the first coil during the call phase, wherein the controlling step comprises;

opening a first switch, and closing a second switch concurrent with the opening step, wherein the second switch is coupled to the first coil and the second coil.

6. The method according to claim 5, further comprising:

sending a current set value signal to the current generator; and outputting an adjustable current amplitude signal by the current generator based upon the sending step.

* * * * *